US011300123B2

(12) United States Patent
Dreifert et al.

(10) Patent No.: US 11,300,123 B2
(45) Date of Patent: Apr. 12, 2022

(54) SCREW VACUUM PUMP WITHOUT INTERNAL COOLING

(71) Applicant: Leybold GmbH, Cologne (DE)

(72) Inventors: Thomas Dreifert, Kerpen (DE); Dirk Schiller, Hürth (DE); Wolfgang Giebmanns, Erftstadt (DE); Roland Müller, Cologne (DE)

(73) Assignee: LEYBOLD GMBH, Cologne (DE)

( * ) Notice: Subject to any disclaimer, the term of this patent is extended or adjusted under 35 U.S.C. 154(b) by 261 days.

(21) Appl. No.: 16/325,347

(22) PCT Filed: Aug. 14, 2017

(86) PCT No.: PCT/EP2017/070566
§ 371 (c)(1),
(2) Date: Feb. 13, 2019

(87) PCT Pub. No.: WO2018/041614
PCT Pub. Date: Mar. 8, 2018

(65) Prior Publication Data

US 2019/0203711 A1 Jul. 4, 2019

(30) Foreign Application Priority Data

Aug. 30, 2016 (DE) ..... 20 2016 005 209.9

(51) Int. Cl.
*F04C 18/08* (2006.01)
*F04C 25/02* (2006.01)
*F04C 18/16* (2006.01)

(52) U.S. Cl.
CPC ..... *F04C 18/082* (2013.01); *F04C 18/084* (2013.01); *F04C 18/16* (2013.01);
(Continued)

(58) Field of Classification Search
CPC ..... F04C 18/082; F04C 18/084; F04C 18/16; F04C 2240/20; F05C 2201/021; F05C 2201/903
See application file for complete search history.

(56) References Cited

U.S. PATENT DOCUMENTS 6,132,103 A 10/2000 Englund
6,382,930 B1 5/2002 Bahnen et al.
(Continued)

FOREIGN PATENT DOCUMENTS

CN 202140315 U 2/2012
CN 102884324 A 1/2013
(Continued)

OTHER PUBLICATIONS

Machine Translation of German Patent Publication DE 102010019402 A1, Inventors: Anitzki et al; Patent publication Nov. 10, 2011. (Year: 2011).*
(Continued)

*Primary Examiner* — Mary Davis
(74) *Attorney, Agent, or Firm* — Ohlandt, Greeley, Ruggiero and Perle, LLP

(57) ABSTRACT

A screw vacuum pump comprises a housing forming a pumping chamber, wherein the housing is made of aluminum or an aluminum alloy. Further provided are two screw rotors arranged in the pumping chamber, each screw rotor comprising at least one displacer element having a helical recess for forming a plurality of windings, wherein the at least one displacer element is made of aluminum or an aluminum alloy. Between the region in which prevail 5% to 30% of the outlet pressure and a pressure-side end of the rotor (pump outlet), at least six, particularly at least eight, and with particular preference at least ten windings are provided.

19 Claims, 2 Drawing Sheets

(52) U.S. Cl.
CPC ..... *F04C 25/02* (2013.01); *F04C 2240/20* (2013.01); *F05C 2201/021* (2013.01); *F05C 2201/903* (2013.01)

(56) References Cited

U.S. PATENT DOCUMENTS

| | | | |
|---|---|---|---|
| 6,758,660 | B2 | 7/2004 | Kriehn et al. |
| 6,918,749 | B2 | 7/2005 | Reinhard et al. |
| 9,541,088 | B2 | 1/2017 | Koichi et al. |
| 2004/0022646 | A1 | 2/2004 | Garczorz |
| 2010/0086883 | A1 | 4/2010 | Zollig et al. |
| 2013/0183185 | A1 | 7/2013 | Dirscherl et al. |
| 2015/0118093 | A1 | 4/2015 | Steffens |
| 2019/0211822 | A1* | 7/2019 | Dreifert ..... F04C 18/16 |

FOREIGN PATENT DOCUMENTS

| | | | |
|---|---|---|---|
| CN | 104395609 | A | 3/2015 |
| DE | 19800711 | | 7/1999 |
| DE | 19800711 | A1 | 7/1999 |
| DE | 10129341 | A1 | 1/2003 |
| DE | 69721031 | T2 | 2/2004 |
| DE | 10334484 | A1 | 3/2005 |
| DE | 102006039529 | A1 | 3/2008 |
| DE | 102010019402 | A1 | 11/2011 |
| EP | 1070307 | A1 | 1/2001 |
| EP | 1242743 | A1 | 9/2002 |
| EP | 1305524 | A1 | 5/2003 |
| EP | 2615307 | A1 | 7/2013 |
| JP | H03111690 | A | 5/1991 |
| JP | H08189485 | A | 7/1996 |
| JP | 2001520353 | A | 10/2001 |
| JP | 2004505210 | A | 2/2004 |
| JP | 2005120955 | A | 5/2005 |
| JP | 2013525690 | A | 6/2013 |
| KR | 20030026992 | | 4/2003 |
| KR | 20130100911 | | 9/2013 |
| WO | 2005038255 | A2 | 4/2005 |

OTHER PUBLICATIONS

Machine Translation of German Patent Publication DE 19800711 A1, Inventors: Steffens et al; Patent publication Jul. 29, 1999. (Year: 1999).*

Machine Translation of Japanese Patent Publication JP 2013-525690; Title: Screw Type Vacuum Pump; Applicant: DREIFERT, Published in Japanese on Jun. 20, 2013. (Year: 2013).*

International Search Report dated Nov. 23, 2017 for PCT application No. PCT/EP2017/070566.

Japanese Office Action (English translation) dated Aug. 10, 2021 for Japanese Appl. No. 2019-511766.

Japanese Office Action (with English translation) dated Feb. 8, 2022 for Japanese Appl. No. 2019-511766.

* cited by examiner

SCREW VACUUM PUMP WITHOUT INTERNAL COOLING

BACKGROUND

1. Field of the Disclosure

The disclosure relates to a screw vacuum pump.

2. Discussion of the Background Art

Screw vacuum pumps comprise, within a housing, a pumping chamber in which two screw rotors are arranged. Each screw rotor comprises at least one displacer element having a helical recess. Thereby, a plurality of windings are formed. To make it possible, by means of screw vacuum pumps, to achieve low pressures and respectively a high vacuum of less than 200 mbar (absolute pressure) while the specific power input is low, known screw vacuum pumps have a high internal compression. The internal compression defines the reduction of the conveying volume from the inlet to the outlet of the pump. Low output pressures are obtained particularly in that a gap with low height is formed between an outer side of the at least one displacer element and an inner side of the pumping chamber. For being able to realize such small gaps, a reliable cooling of the screw rotors must be guaranteed. Only thereby, it can be prevented that, particularly in the pressure-side region of the screw vacuum pump where high pressure differences occur, the temperature of the rotor and thus of the at least one displacer element of the rotor might rise in such a manner that, due to the expansion of the displacer elements resulting from the temperature, there will be caused a mutual contacting between the outer side of the displacer element and the inner side of the pumping chamber.

In this regard, it is known from EP 1 242 743 to provide internal cooling for the rotor. The internal cooling for the rotor will guarantee an effective cooling of the rotor and thus of the at least one displacer element that is connected to the rotor or is formed in one piece with it, thus rendering it possible to realize small gap heights. Such an internal cooling for the rotor is very complex and thus expensive.

It is an object of the disclosure to provide a screw vacuum pump by which a high vacuum of particularly less than 200 mbar and with particular preference less than 10 mbar can be achieved while an internal cooling for the rotor can be omitted.

SUMMARY

The screw vacuum pump of the disclosure comprises a housing which defines a pumping chamber having the two screw rotors arranged in it. According to the disclosure, the housing and the rotors are made of aluminum or an aluminum alloy. Particularly preferred herein as an aluminum alloy for the housing are AlSi7Mg or AlMg0.75Si. Particularly, the expansion coefficient of the material of the screw rotors is lower than the expansion coefficient of the material of the housing. It is particularly preferred that the expansion coefficient of the screw rotors is less than $22*10^{-6}$ 1/K and with particular preference less than $20*10^{-61}$/K.

The two screw rotors arranged in the pumping chamber comprise at least one displacer element which has a helical recess. The helical recesses define a plurality of windings. According to the disclosure, the at least one displacer element is made of aluminum or an aluminum alloy. It is preferred to produce at least one displacer elements from AlSi9Mg or AlSi17Cu4Mg. It is particularly preferred that the aluminum and respectively the aluminum alloy have a lower expansion coefficient of particularly less than $22*10^{-6}$ 1/K and with particular preference less than $20*10^{-6}$ 1/K.

It is particularly preferred that the screw rotor and particularly the at least one displacer element have, in each screw rotor, a lower expansion coefficient than the housing. It is particularly preferred herein that the expansion coefficient of the housing is at least 5% and with particular preference at least 10% larger than that of the screw rotors and respectively of the at least one displacer element. It is particularly preferred that the alloy of the rotor has a high silicon percentage of preferably at least 9%, with particular preference more than 15% so as to realize a low thermal expansion coefficient.

According to the disclosure, the screw rotors and the at least one displacer element are designed in such a manner that, between the region in which prevail 5% to 20% of the outlet pressure and a pressure-side end of the rotor, at least 6, particularly at least 8, and with particular preference at least 10 windings are provided. The pressure-side rotor end herein is the region of the pump outlet. Herein, according to a preferred embodiment, the high number of windings, according to the disclosure, in this region can be provided in a single pressure-side displacer element provided per rotor. It is also possible, however, to provide a corresponding number of windings in this pressure-side region e.g. on two displacer elements. By providing, according to the disclosure, a high number of windings in a region where, according to the disclosure, there will then occur only a relatively low compression of the to-be-conveyed medium per winding, it is rendered possible to omit an interior cooling of the rotor. This is possible particularly because, due to the relatively low compression in this region, the increase in temperature of the displacer element in this region resulting from the compression is lower. Further, again because of the relatively high density of the medium in this region, the conveyed medium itself will effect a high heat dissipation from the displacer element to the pump housing.

Further, as a result of the large number of windings, a large surface area is available for heat exchange toward the housing.

It is particularly preferred that the at least 6, particularly at least 8 and with particular preference at least 10 windings are provided in a pressure-side displacer element. Herein, it particularly of preference that the pressure ratio effected by the pressure-side displacer element (=outlet pressure/intermediate pressure before the pressure-side displacer element) is less than 20, particularly less than 10 and with particular preference less than 5. Thus, upon compression to atmospheric pressure at the pump outlet, the last 6, particularly the last 8 and with particular preference the last 10 windings provided by the disclosure will achieve a compression from 50 mbar to 1,000 mbar with a pressure ratio of 20. Thus, at a pressure ratio of 10, there will occur a compression from 100 mbar to 1,000 mbar and, at a pressure ratio of 5, a compression from 200 mbar to 1,000 mbar.

The distance from a region where 5%-20% of the outlet pressure prevail, to the last winding in the direction of conveyance, i.e. substantially to the pump outlet, is preferably at least 20%-30% of the rotor length. This has the advantage that, in a relatively large region, only a very low compression will still occur. This in turn will result in a relatively low increase in temperature due to the low compression.

Further, for the design—as provided by the disclosure—of screw rotors without internal cooling, it is preferred that the pressure-side displacer element at a minimum of 6, particularly at a minimum of 8 and with particular preference at a minimum of 10 windings has an average working pressure of more than 50 mbar. In the final-pressure operation of the pump, i.e. in the closed state of the inlet, a pressure (averaged over time) of 50 mbar is reached in this region of the pump.

According to the disclosure, it is thus possible, also in rotors without interior cooling and in case of a housing made of aluminum or an aluminum alloy and with at least one displacer element made of aluminum or an aluminum alloy, to provide—between the surface of the at least one displacer element and the inner side of the pumping chamber, particularly in the pressure-side region—a cold gap having a height in the range from 0.05 mm-0.3 mm and particularly 0.1 mm-0.2 mm. Such a relatively large gap height can be provided because of the above described design, in accordance with the disclosure, of the 6, particularly 8 and with particular preference 10 last windings.

Each displacer element preferably comprises at least one helical recess which has the same contour along its entire length. Preferably, the contours are different for each displacer element. Thus, a respective displacer element preferably comprises a constant pitch and a uniform contour. As a result, manufacture is considerably facilitated so that the production costs can be massively lowered.

For further improvement of the suction capacity, the contour of the suction-side displacer element, i.e. particularly the first displacer element as viewed in the pumping direction, is asymmetric. By the asymmetric shape of the contour or profile, the flanks can be designed in such a manner that the leakage surfaces, the so-called blowholes, are preferably entirely eliminated or at least have a small cross section. A particularly useful asymmetric profile is the so-called "Quimby profile". Even though such a profile is relatively difficult to manufacture, it has the advantage that there is no continuous blowhole. A short circuit exists only between two adjacent chambers. Since the profile is an asymmetric profile having different profile flanks, manufacture thereof requires at least two working steps because the two flanks, due to their asymmetry, have to be produced in two different working steps.

The pressure-side displacer element, particularly the last displacer element as viewed in the pumping direction, is preferably provided with a symmetric contour. The symmetric contour particularly has the advantage that the manufacture will be simpler. Particularly, both flanks with symmetric contour can be generated in one working step by use of a rotating end mill or a rotating side milling cutter. Although symmetric profiles of this type comprise blowholes, these are provided continuously, i.e. are not only provided between two adjacent chambers. The size of the blowhole decreases with decreasing pitch. Accordingly, such symmetric profiles can be provided particularly for the pressure-side displacer element since these, according to a preferred embodiment, have a smaller pitch than the suction-side displacer element and preferably also than the displacer element arranged between the suction-side displacer element and the pressure-side displacer element. Even though the leak-tightness of such symmetric profiles is somewhat lower, these have the advantage that their manufacture is distinctly simpler. Particularly, it is rendered possible to generate the symmetric profile in a single working step by use of a simple end mill or side milling cutter. Thereby, the costs are considerably reduced. A particularly useful symmetric profile is the so-called "cycloidal profile".

The provision of at least two such displacer elements makes it possible that the corresponding screw vacuum pump can generate low inlet pressures while the power input is low. Further, the thermal stress is low. The arranging of at least two displacer elements designed according to the disclosure, having a constant pitch and a uniform contour, in a vacuum pump will substantially lead to the same results as in a vacuum pump having a displacer element with varying pitch. In case of high specified volume ratios, three or four displacer elements can be provided, depending on the rotor.

For reducing the achievable inlet pressure and/or for reducing the power input and/or the thermal stress, it is provided according to a particularly preferred embodiment that a pressure-side displacer element, i.e. particularly the last displacer elements as viewed in the pumping direction, comprises a large number of windings. Due to the large number of windings, there can be accepted a larger gap between the screw rotor and the housing, while the performance will remain the same. The gap herein can have a cold gap width in the range from 0.05-0.3 mm. A large number of outlet windings and respectively of windings in the pressure-side displacer element is inexpensive in production since, according to the disclosure, this displacer element has a constant pitch and particularly also a symmetric contour. This allows for a simple and inexpensive production process so that the provision of a larger number of windings is acceptable. Preferably, this pressure side displacer element or last displacer element comprises more than 6, particularly more than 8 and with particular preference more than 10 windings. The use of symmetric profiles has the advantage, in a particularly preferred embodiment, that, by use of a milling cutter, both flanks of the profile can be cut simultaneously. In this process, the milling cutter is additionally supported by the respective opposite flank, thus avoiding deformation or deflection of the milling cutter during and resulting inaccuracies.

For further reduction of the manufacturing costs, it is particularly preferred that the displacer elements and the rotor shaft are formed as one piece.

According to a further preferred embodiment, the change of pitch between adjacent displacer elements is provided in a non-uniform or abrupt manner. Optionally, the two displacer elements are arranged at a distance from each other in the longitudinal direction so that, between two displacer elements, a surrounding ring-shaped cylindrical chamber is formed which serves as a tool run-out zone. This is advantageous particularly in rotors of a one-pieced configuration because, in this region, the tool generating the helical line can be withdrawn in a simple manner. In case that the displacer elements are manufactured independently from each other and then are mounted on a shaft, provision of a tool run-out zone, particularly of such a ring-shaped cylindrical region, will not be necessary.

According to a preferred embodiment of the disclosure, no tool run-out zone is provided between two adjacent displacer elements at the pitch change. In the region of the pitch change, preferably both flanks comprise a void or recess so as to allow the tool to be withdrawn. Such a void has no noteworthy influence on the compression performance of the pump because the void or recess is local and quite limited in size.

The vacuum pump screw rotor of the disclosure particularly comprises a plural number of displacer elements. These can each time have the same diameter or different diameters. In this respect, it is preferred that the pressure-side displacer element has a smaller diameter than the suction-side displacer element.

In case of displacer elements produced independently from the rotor shaft, the displacer elements will be mounted on the shaft e.g. by press fitting. Herein, it is preferred to provide elements such as dowel pins for fixation of the angular position of the displacer elements relative to each other.

Particularly in case of a one-pieced design of the screw rotor but also in case of a multi-pieced design, it is preferred to produce the screw rotor from aluminum or an aluminum alloy. It is particularly preferred to produce the rotor from aluminum or an aluminum alloy, particularly from AlSi9Mg or AlMg0.7Si. The alloy preferably has a silicon percentage of more than 9%, particularly more than 15%, so as to reduce the expansion coefficient.

According to a further preferred embodiment of the disclosure, the aluminum used for the rotors has a low expansion coefficient. It is preferred that the material has an expansion coefficient of less than $22*10^{-6}$1/K, particularly less than $20*10^{-6}$1/K. According to a further preferred embodiment, the surface of the displacer elements is coated, there being provided particularly a coating against wear and/or corrosion. Herein, there is provided with preference an anodic coating or another suitable coating, depending on the field of application.

It is particularly preferred that the screw rotor is manufactured in one piece, particularly from aluminum or an aluminum alloy. The screw rotor can also comprise a rotor shaft carrying the at least one displacer element. This has the advantage, particularly if a plurality of displacer elements are provided, that these can be produced independently from each other and then will be connected to the rotor shaft, particularly by pressing or shrinking them into place. Herein, it is possible, for definition of the angular position of the individual displacer elements, to provide fitting keys or the like. The rotor shaft can be made of steel and carry the at least one displacer element made of aluminum or an aluminum alloy.

In case of the preferred provision of a plural number of displacer elements per screw rotor, it is possible to design the displacer elements as one-pieced members.

According to the disclosure, it is preferred that the screw rotors have no interior cooling. In this respect, it is particularly preferred that the screw rotors do not comprise channels with —particularly liquid—coolant flowing through them. However, the screw rotors can comprise bores or channels, e.g. for weight reduction, for balancing and the like. Particularly, it is preferred that the screw rotors are solid.

Further, it is preferred that, in the region of the pressure-side displacer elements, i.e. particularly in the region of the last 6, particularly the last 8 and with particular preference the last 10 windings, a slight difference in temperature exists between the displacer elements and the housing. In normal operation, this difference in temperature is preferably smaller than 50 K and particularly smaller than 20 K. Normal operation is to be understood as the entire suctioning pressure range from the final pressure up to an open inlet (atmospheric suctioning).

Further, it is preferred that the housing in the region of the pressure-side displacer elements, i.e. particularly in the region of the last 6, particularly the last 8 and with particular preference the last 10 windings, has an average heat flux density of less than 20,000 W/m$^2$, preferably less than 15,000 W/m$^2$ and particularly less than 10,000 W/m$^2$. The average heat flux density is the ratio between the compression performance and the wall surface area of the outlet region.

The disclosure will be explained in greater detail hereunder by way of a preferred embodiment and with reference to the accompanying drawings.

BRIEF DESCRIPTION OF THE DRAWINGS

The following is shown.

DETAILED DESCRIPTION OF THE PREFERRED EMBODIMENT

Figure 1:
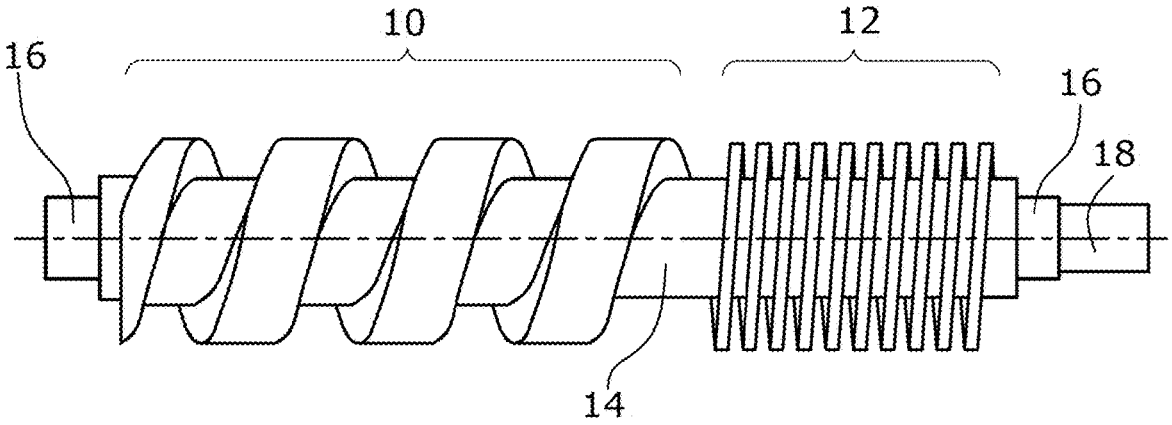
FIG. 1 shows a schematic plan view of a first preferred embodiment of a screw rotor of the screw vacuum pump of the disclosure.
Figure 2:
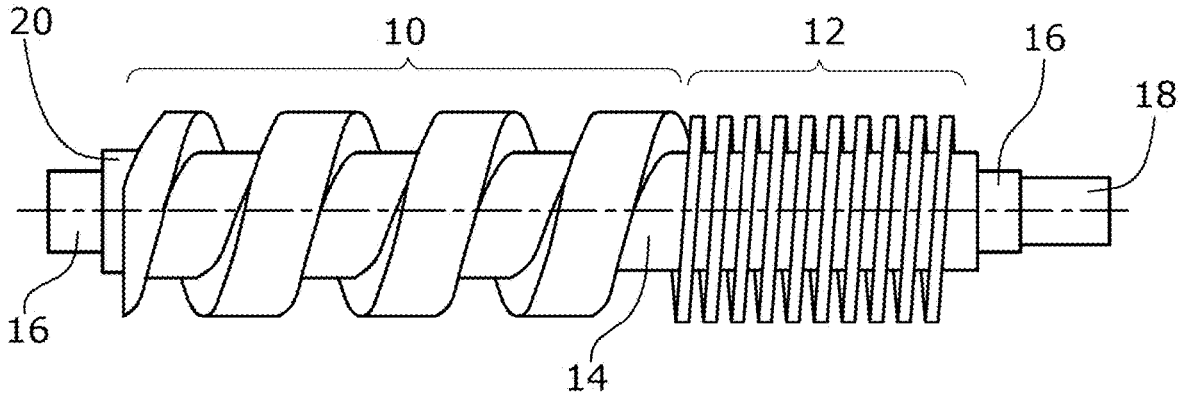
FIG. 2 shows a schematic plan view of a second preferred embodiment of a screw rotor of the screw vacuum pump of the disclosure.
Figure 5:
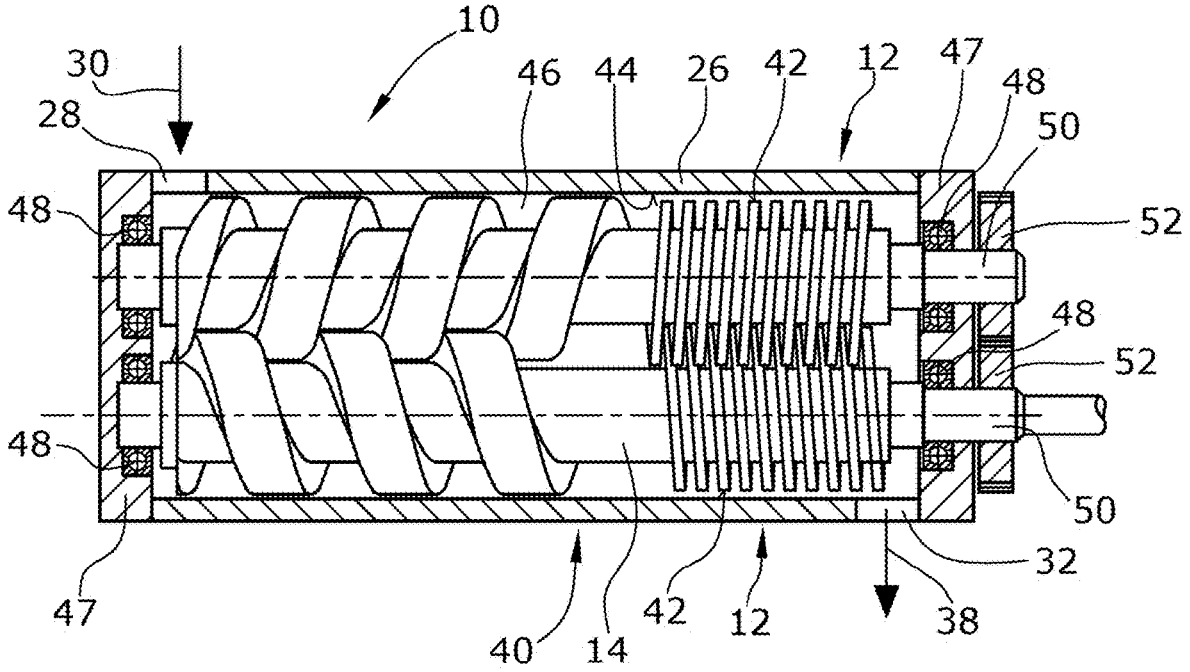
FIG. 5 shows a schematic sectional view of a screw vacuum pump.

The screw rotors shown in FIGS. 1 and 2 can be used in a screw vacuum pump as shown in FIG. 5.

According to the first preferred embodiment of the vacuum pump screw rotor, the rotor comprises two displacer elements 10, 12. A first, suction-side displacer element 10 has a large pitch of about 10-150 mm/revolution. The pitch is constant along the entire displacer element 10. Also the contour of the helical recess is constant. The second, pressure-side displacer element 12 again has, along its length, a constant pitch and a constant contour of the recess. The pitch of the pressure-side displacer element 12 is preferably in the range of 10-30 mm/revolution. Between the two displacer elements, a ring-shaped cylindrical recess 14 is provided. Said recess has the purpose of realizing a tool run-out zone in view of the one-pieced design of the screw rotor shown in FIG. 1.

Further, the one-pieced screw rotor comprises two bearing seats 16 and shaft end 18. To the shaft end 18, there is connected e.g. a toothed wheel for driving.

In the second preferred embodiment shown in FIG. 2, the two displacer elements 10, 12 are produced separately and will then be fixed on a rotor shaft 20 e.g. by pressing them on. This production method may be somewhat more complex but there is obviated the need for the cylindrical distance 14 between two adjacent displacer elements 10, 12 for tool run-out. The bearing seats 16 and the shaft ends 18 can be integral components of the shafts 20. Alternatively, a continuous shaft 20 can also be produced from another material that is different from the displacer elements 10, 12.

Figure 3:
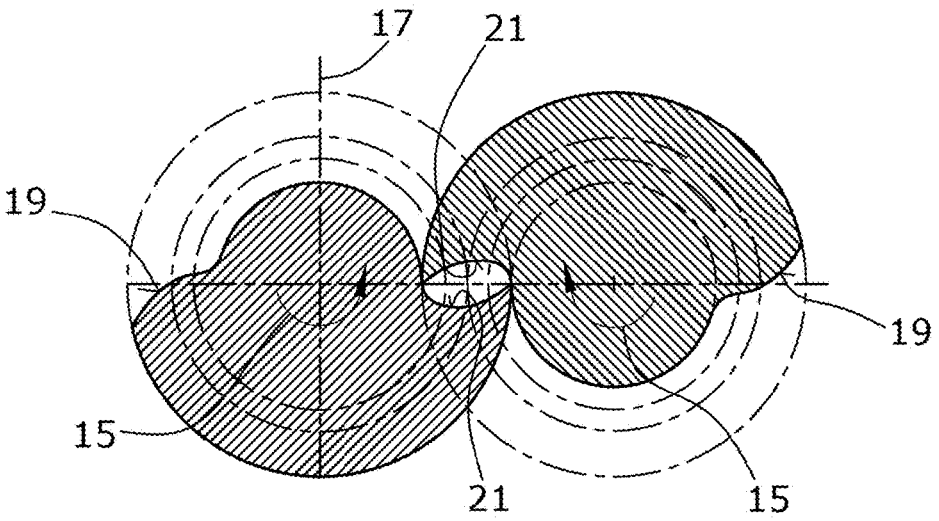
FIG. 3 shows a schematic sectional view of displacer elements with asymmetric profile.

FIG. 3 shows a schematic lateral view of an asymmetric profile (e.g. a Quimby profile). The asymmetric profile shown is a so-called "Quimby profile". The sectional view shows two screw rotors which mesh with each other and whose longitudinal direction extends vertically to the plane of the drawing. The rotation of the rotors in opposite senses in indicated by the two arrows 15. With respect to a plane 17 extending vertically to the longitudinal axis of the displacer elements, the profiles of the two flanks 10 and 21 are different in each rotor. Thus, the mutually opposite flanks 19, 21 have to be produced independently from each other. However, in the manufacture which for this reason is somewhat more complex and difficult, an advantage resides in that there does not exist a throughgoing blowhole but only a short circuit between two adjacent chambers.

Such a symmetric profile is preferably provided in the suction-side displacer element 10.

Figure 4:
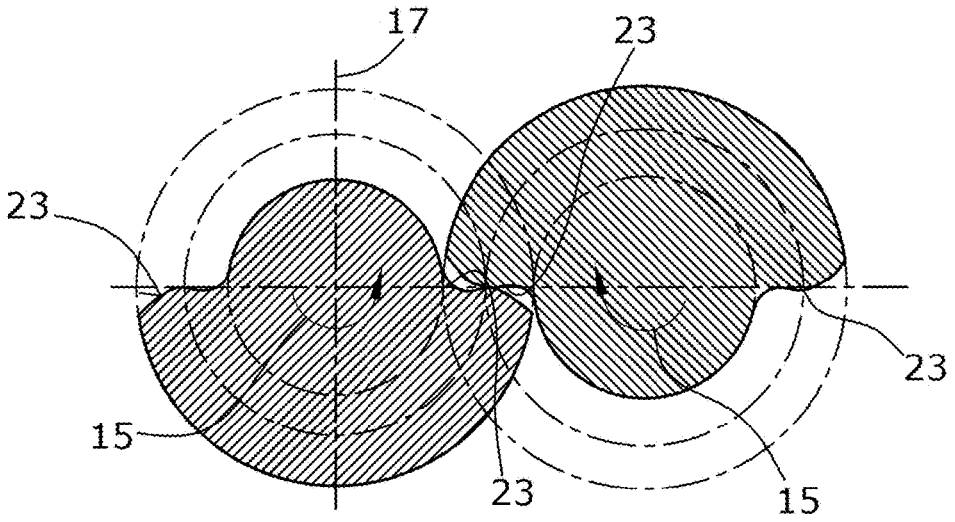
FIG. 4 shows a schematic sectional view of displacer elements with symmetric profile.

The schematic lateral view in FIG. 4, in turn, shows a sectional view of two displacer elements and respectively two screw rotors which again rotate in opposite senses (arrows 15). With respect to the axis of symmetry 17, the flanks 23 have a symmetric design in each displacer element. In the preferred embodiment of a symmetrically designed contour shown in FIG. 4, a cycloidal profile is used.

A symmetric profile as shown in FIG. 4 is preferably provided in the pressure-side displacer elements 12.

Further, it is possible to provide more than two displacer elements. These can optionally have different head diameters and corresponding foot diameters. Herein, it is preferred that a displacer element with larger head diameter is arranged at the inlet, i.e. on the suction side, so as to realize a larger suctional capacity in this region and/or to increase the volume ratio. Also combinations of the above described embodiments are possible. For instance, two or more displacer elements can be produced in one piece with the shaft, or an additional displacer element can be produced independently from the shaft and then be mounted on the shaft.

In the schematic view of FIG. 5, showing a preferred embodiment of a screw vacuum pump of the disclosure, two screw rotors as shown in FIG. 1 are arranged in a housing 26. The vacuum pump housing 26 comprises an inlet 28 through which gas is sucked in the direction of arrow 30. The inlet 28 is connected e.g. to a chamber which is to be evacuated. Pump housing 26 further comprises a pressure-side outlet 32 through which gas is discharged in the direction of arrow 38. Preferably, the screw vacuum pump of the disclosure will pump immediately against atmosphere so that no pre-vacuum pump is connected to the outlet 32 anymore, while this would also be possible.

In the illustrated exemplary embodiment, the two pressure-side displacer elements 12 comprise 10 windings per screw rotor. Particularly, in a region 40, i.e. in a region of the first winding of the pressure-side displacer element 12 as viewed in the conveying direction, there prevails a pressure of 5%-20% of the pressure prevailing at the outlet 32.

Between the surfaces 42 of the two pressure-side displacer elements 12 and an inner surface 44 of a pumping chamber 46 defined by the pump housing 26, a gap is formed whose height is preferably in the range from 0.05 mm-0.3 mm and particularly in the range from 0.1 mm-0.2 mm.

In the illustrated exemplary embodiment, the vacuum pump housing 26 is closed by two housing covers 47. The left housing cover 47 in FIG. 4 comprises two bearing seats in which respectively one ball bearing 48 arranged for support of the two rotor shafts. On the right-hand side in FIG. 4, the shaft journals 50 of the two screw rotor shafts extend through the covers 47. On the outer side, the two shaft journals 50 have a respective toothed wheel 52 arranged on them. In the illustrated exemplary embodiment, the toothed wheels 52 mesh with each other for mutual synchronization of the two screw rotors. Further, also in the right-hand cover 47 as viewed in FIG. 4, two bearings 48 are arranged for support of the screw rotors.

The lower shaft in FIG. 5 is the drive shaft, which is connected to a drive motor, not shown.

Particularly good results according to the disclosure can obtained by the following specification which therefore is especially preferred:

| | |
|---|---|
| material of housing | AlSi7Mg (cast, expansion coefficient 22 * $10^{-6}K^{-1}$ or AlMg0.7Si (extrusion, expansion coefficient 23 * $10^{-6}K^{-1}$) |
| material of rotor | AlSi9Mg (cast, expansion coefficient 21 * $10^{-6}K^{-1}$) or AlSi17Cu4Mg (cast, expansion coefficient 18 * $10^{-6}K^{-1}$) |

-continued

| | |
|---|---|
| Silicon percentage of rotor | at least 9%, particularly preferred more than 15% |
| thermal expansion coefficient of housing/rotor | at least 5% larger, particularly preferred 10% larger |

Intermediate Pressure Between the Suction-Side and the Pressure-Side Displacer Element:

Pressure Ratio

Outlet Pressure/Intermediate Pressure

Particularly Preferred Less than:

$$\frac{1000\text{ mbar}}{200\text{ mbar}} = 5 \quad \text{intermediate pressure} = 20\%\text{ outlet pressure}$$

Particularly less than $$\frac{1000\text{ mbar}}{100\text{ mbar}} = 10 \quad \text{intermediate pressure} = 10\%\text{ outlet pressure}$$

Less than $$\frac{1000\text{ mbar}}{50\text{ mbar}} = 20 \quad \text{intermediate pressure} = 5\%\text{ outlet pressure}$$

height of cold gap 0.05 mm-0.3 mm

Particularly preferred 0.1 mm-0.2 mm

What is claimed is:

1. A screw vacuum pump, comprising:

a housing defining a pumping chamber, wherein the housing is made of aluminum or an aluminum alloy, and two screw rotors arranged in the pumping chamber, each screw rotor comprising two displacer elements having a helical recess for defining a plurality of windings, wherein the two displacer elements are made of aluminum or an aluminum alloy, wherein at least six windings are provided for a prevailing suction pressure of less than 200 mbar between a region in which 5% to 20% of an outlet pressure and a pressure-side end of the two screw rotors prevails, and wherein the two displacer elements comprise a pressure-side displacer element and a further displacer element for each of the two screw rotors, wherein the pressure-side displacer element and the further displacer element have recesses, wherein each recess has a uniform contour along an entire length thereof.

2. The screw vacuum pump according to claim 1, wherein the pressure-side displacer element causes a pressure ratio of less than 20.

3. The screw vacuum pump according to claim 1, wherein the pressure-side displacer element has an average working pressure of more than 50 mbar in the at least six windings.

4. The screw vacuum pump according to claim 1, wherein, between a surface of at least one of the two displacer elements and an inner surface of the pumping chamber, a gap having a height in the range from 0.05 mm to 0.3 mm is formed.

5. The screw vacuum pump according to claim 1, wherein the pressure-side displacer element has a constant pitch over an entire length.

6. The screw vacuum pump according to claim 1, wherein the recesses of the pressure-side displacer element has a symmetrical contour over an entire length.

7. The screw vacuum pump according to claim 1, wherein the pressure-side displacer element is single-threaded.

8. The screw vacuum pump according to claim 1, wherein each screw rotor comprises a rotor shaft supporting one of the two displacer elements.

9. The screw vacuum pump according to claim 1, wherein the two displacer elements are formed in one piece.

10. The screw vacuum pump according to claim 1, wherein the two screw rotors are made of aluminum or an aluminum alloy having an expansion coefficient of less than $22*10^{-6}$ 1/K.

11. The screw vacuum pump according to claim 1, wherein the two displacer elements have, for each screw rotor, a lower expansion coefficient than the housing, wherein the expansion coefficient of the housing is at least larger than that of the two screw rotors and respectively of the two displacer elements.

12. The screw vacuum pump according to claim 1, wherein the two screw rotors do not have a rotor interior cooling.

13. The screw vacuum pump according to claim 1, wherein the two screw rotors do not comprise channels having coolant flowing through them.

14. The screw vacuum pump according to claim 1, wherein the two screw rotors are solid.

15. The screw vacuum pump according to claim 1, wherein a temperature difference in a region between the pressure-side displacer element and the housing in normal operation is less than 50K.

16. The screw vacuum pump according to claim 1, wherein, in the region of the pressure side displacer element, an average heat flux density is less than 20000 $W/m^2$.

17. The screw vacuum pump according to claim 1, wherein a distance between the region in which prevail 5% to 20% of the outlet pressure, up to the last winding of the pressure-side displacer element is at least in the range from 20% to 30% of the rotor length.

18. The screw vacuum pump according to claim 1, wherein the at least six windings comprise at least eight windings.

19. The screw vacuum pump according to claim 1, wherein the at least six windings comprise at least ten windings.

* * * * *